US008452021B2

(12) United States Patent
Yanz et al.

(10) Patent No.: US 8,452,021 B2
(45) Date of Patent: May 28, 2013

(54) REAL EAR MEASUREMENT SYSTEM USING THIN TUBE

(75) Inventors: Jerry Yanz, North Oaks, MN (US); Sidney A. Higgins, Maple Grove, MN (US); Robert P. Jacoby, Plymouth, MN (US); Tao Zhang, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1412 days.

(21) Appl. No.: 12/102,602

(22) Filed: Apr. 14, 2008

(65) Prior Publication Data

US 2008/0260192 A1 Oct. 23, 2008

Related U.S. Application Data

(60) Provisional application No. 60/912,343, filed on Apr. 17, 2007.

(51) Int. Cl.
*H04R 25/00* (2006.01)

(52) U.S. Cl.
USPC ..... 381/60; 381/330; 600/559

(58) Field of Classification Search
USPC ..... 381/60, 330; 600/559
See application file for complete search history.

(56) References Cited

U.S. PATENT DOCUMENTS 3,491,214 A 1/1970 Rosemond et al.
4,564,955 A * 1/1986 Birch et al. ..... 381/330
4,809,708 A 3/1989 Geisler et al.
5,386,475 A 1/1995 Birck et al.
5,711,308 A 1/1998 Singer
5,792,073 A * 8/1998 Keefe ..... 600/559
5,897,494 A 4/1999 Flock et al.
5,987,146 A 11/1999 Pluvinage et al.
6,007,494 A 12/1999 Zenner et al.
D431,294 S 9/2000 Barnard et al.

(Continued)

FOREIGN PATENT DOCUMENTS

AU 5830898 A 9/1998
AU 2010200103 B2 7/2011

(Continued)

OTHER PUBLICATIONS

"European Application Serial No. 08251441.5, Partial European Search Report mailed Jul. 14, 2011", 5 pgs.

(Continued)

*Primary Examiner* — David S. Warren
(74) *Attorney, Agent, or Firm* — Schwegman Lundberg & Woessner, P.A.

(57) ABSTRACT

An embodiment of a hearing assistance apparatus for performing a Real Ear Measurement (REM), comprises a hearing assistance device housing, a microphone within the housing, an earhook connected to the housing, and a flexible tube. The house has a first opening for guiding sound into the housing to the microphone. The housing and the connected earhook form an interface, where the earhook has a shape to provide a slot near the interface of the housing and the earhook. The tube guides sound, and has a first end and a second end. The first end of the flexible tube and the slot of the earhook cooperate to retain the first end of the flexible tube in the slot of the earhook and flush with the housing to provide a sound-tight connection with the first opening.

24 Claims, 5 Drawing Sheets

U.S. PATENT DOCUMENTS

| | | | | |
|---|---|---|---|---|
| 6,154,546 | A | 11/2000 | Uvacek | |
| 6,674,862 | B1 | 1/2004 | Magilen | |
| D506,258 | S | 6/2005 | Nielsen | |
| 7,239,711 | B1 | 7/2007 | Andersen et al. | |
| 7,599,508 | B1 | 10/2009 | Lynch et al. | |
| 7,756,283 | B2 | 7/2010 | Bramslow | |
| 7,778,424 | B2 * | 8/2010 | Lange | 381/60 |
| 8,059,847 | B2 | 11/2011 | Nordahn | |
| 2002/0085729 | A1 | 7/2002 | Marx | |
| 2004/0028250 | A1 | 2/2004 | Shim | |
| 2004/0044389 | A1 | 3/2004 | Crawford | |
| 2004/0234094 | A1 | 11/2004 | Saunders et al. | |
| 2005/0002539 | A1 | 1/2005 | Nielsen | |
| 2006/0045282 | A1 | 3/2006 | Reber | |
| 2006/0171550 | A1 | 8/2006 | Bryant et al. | |
| 2007/0009107 | A1 * | 1/2007 | Lange | 381/60 |
| 2007/0217639 | A1 | 9/2007 | Stirnemann | |
| 2008/0152178 | A1 | 6/2008 | Topholm et al. | |
| 2008/0194984 | A1 | 8/2008 | Keefe | |
| 2008/0260193 | A1 | 10/2008 | Westermann et al. | |
| 2008/0298600 | A1 | 12/2008 | Poe et al. | |
| 2009/0245525 | A1 | 10/2009 | Zhang et al. | |
| 2009/0245560 | A1 | 10/2009 | Zhang et al. | |
| 2009/0299215 | A1 | 12/2009 | Zhang | |
| 2010/0202642 | A1 | 8/2010 | LoPresti et al. | |
| 2010/0246869 | A1 | 9/2010 | Zhang et al. | |
| 2010/0260343 | A1 | 10/2010 | Recker et al. | |
| 2011/0098551 | A1 | 4/2011 | Zhang | |

FOREIGN PATENT DOCUMENTS

| | | | |
|---|---|---|---|
| AU | 2010201189 | | 9/2011 |
| AU | 2009201227 | B2 | 10/2011 |
| AU | 2009201228 | B2 | 1/2012 |
| DE | 4327634 | C1 | 6/1994 |
| EP | 0381608 | A2 | 8/1990 |
| EP | 1448014 | B1 | 10/2005 |
| EP | 1705950 | A2 | 9/2006 |
| EP | 2107831 | A2 | 10/2009 |
| WO | WO-8901315 | A1 | 2/1989 |
| WO | WO-9931936 | A1 | 6/1999 |
| WO | WO-0239784 | A1 | 5/2002 |
| WO | WO-2005089016 | A1 | 9/2005 |
| WO | WO-2007045254 | A1 | 4/2007 |
| WO | WO-2007045271 | A1 | 4/2007 |

OTHER PUBLICATIONS

Chan, C K, et al., "Estimation of Eardrum Acoustic Pressure and of Ear Canal Length From Remote Points in the Canal Length From Remote Points in the Canal", Journal of the Acoustical Society of America, vol. 87, No. 3, XP009035813 ISSN: 0001-4966, (Mar. 1, 1990), 1237-1247.

Dillon,Ph.D., Harvey, "Hearing Aids", 4.4 Practical Issues in Real-Ear Testing, (Jan. 1, 2001), 101-104.

Hudde, H, et al., "Methods for Estimating the sound pressure at the eardrum", Journal of the Acoustical Society of America, vol. 106, No. 4, XP012001248 ISSN: 0001-4966, (Oct. 1, 2009), 1977-1992.

Moodie, K Shane, et al., "Procedure for Predicting Real-Ear Hearing Aid Performance in Young Children", Am. Journal of Audiology, Am. Speech-Language-Hearing Association, 3(1), (Mar. 1, 1994), 23-31.

Munro, Kevin J, et al., "Measuring the Real-Ear to Coupler Difference Transfer Function with and Insert Earphone and a Hearing Instrument: Are they the same?", Ear and Hearing, 26(1), (Feb. 1, 2005), 27-34.

Pascal, Jerome, et al., "Linear and nonlinear model of the human middle ear", J. Acoust. Soc. Am., vol. 104, No. 3, Pt. 1, (Sep. 1998), 1509-1516.

Yanz, Jerry, et al., "Real Ear Measurement System Using Thin Tube", U.S. Appl. No. 60/912,343, filed Apr. 17, 2007, 19 pgs.

* cited by examiner

REAL EAR MEASUREMENT SYSTEM USING THIN TUBE

RELATED APPLICATION

This application claims the benefit of U.S. Provisional Application Ser. No. 60/912,343 filed Apr. 17, 2007, which is incorporated herein by reference in its entirety.

TECHNICAL FIELD

This application relates to hearing assistance devices, and more particularly, to real ear measurement (REM) systems for hearing assistance devices.

BACKGROUND

Hearing assistance devices are electronic devices that provide signal processing functions such as noise reduction, amplification, and tone control. In many hearing assistance devices these and other functions can be programmed to fit the requirements of individual users. Performance of a user's hearing assistance device, while the device is in the user's ear, is difficult to measure. The expense of measurement equipment, the time it takes to make the measurements, and the perceived complexity of the procedure, have all proven to be obstacles to widespread use of such measurements. However, such measurements may enable better programming of a user's hearing assistance device because each user's ear is different. There is a need in the art for improved systems to assist in measuring the performance of a hearing assistance device while the device is in the user's ear.

SUMMARY

The present subject matter provides apparatus and methods for real ear measurements of hearing assistance devices disposed in the ear of a user. Examples are provided, such as an apparatus including a thin tube for detecting sounds near the user's ear canal with an occluding portion of the hearing assistance device inserted in the user's ear. The thin tube includes a coupler for connecting the tube to the hearing assistance device. In other examples, a stretchable band of material is included for blocking ports about the housing of the hearing assistance device such that interference from such ports reaching the thin tube microphone is attenuated so as not to interfere with the measurement.

The present subject matter also provides methods of making real ear measurements. An example of the method is provided and includes a first procedure of generating a tonal complex signal, analyzing the signal in the frequency domain, applying gains based on pre-stored coupler response data, synthesizing the signal in the frequency domain, presenting the signal to the user's ear canal using the receiver of a hearing assistance device, capturing the sound near the user's ear drum using, for example, a first end of a thin tube, analyzing the signal received from a microphone of the hearing assistance device located near the second end of the thin tube, monitoring the signal against limits related to user comfort and output performance of the receiver, and comparing the captured response with a desired response to derive gains that compensate for the shape and volume of the user's ear canal. The second portion of the example procedure includes generating a tonal complex signal, applying the gains from the first portion of the procedure, presenting the signal to the user's ear canal, collecting several samples of the signal near the user's ear drum, analyzing the signal for a bad sample, collecting a number of good samples and averaging the samples to provide an accurate model of the user's real ear response.

This Summary is an overview of some of the teachings of the present application and is not intended to be an exclusive or exhaustive treatment of the present subject matter. Further details about the present subject matter are found in the detailed description. The scope of the present invention is defined by the appended claims and their equivalents.

DETAILED DESCRIPTION

The following detailed description refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Figure 1A:
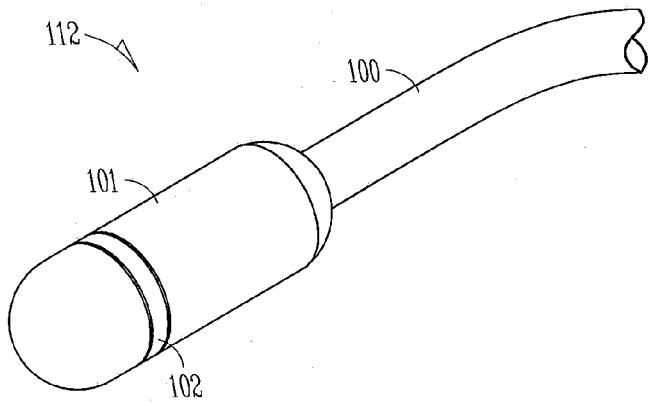
FIG. 1A illustrates an embodiment of a flexible sound tube according to the present subject matter.

FIG. 1A illustrates an embodiment of a sound tube 112. The sound tube 112 includes a flexible tube 100 and a plug 101 at one end for providing a sound tight connection with a target device. In one example, the plug 101 includes a recess 102 around the plug 101 to aid retaining the plug 101 in the receptacle of a target device. The tube 100 is very flexible and allows for insertion into the ear canal along side an earmold. Examples of tube materials include a Dow Corning product, part number Q7-4765, a 60 durometer silicone material. Examples of coupling materials include a Dow Corning product; part number Q74850, a 50 durometer material. The example plug materials can be compressed to insert into a tight fitting receptacle and upon relaxation tend to expand to the shape of the receptacle, therefore, forming a sound tight seal.

Figure 1B:
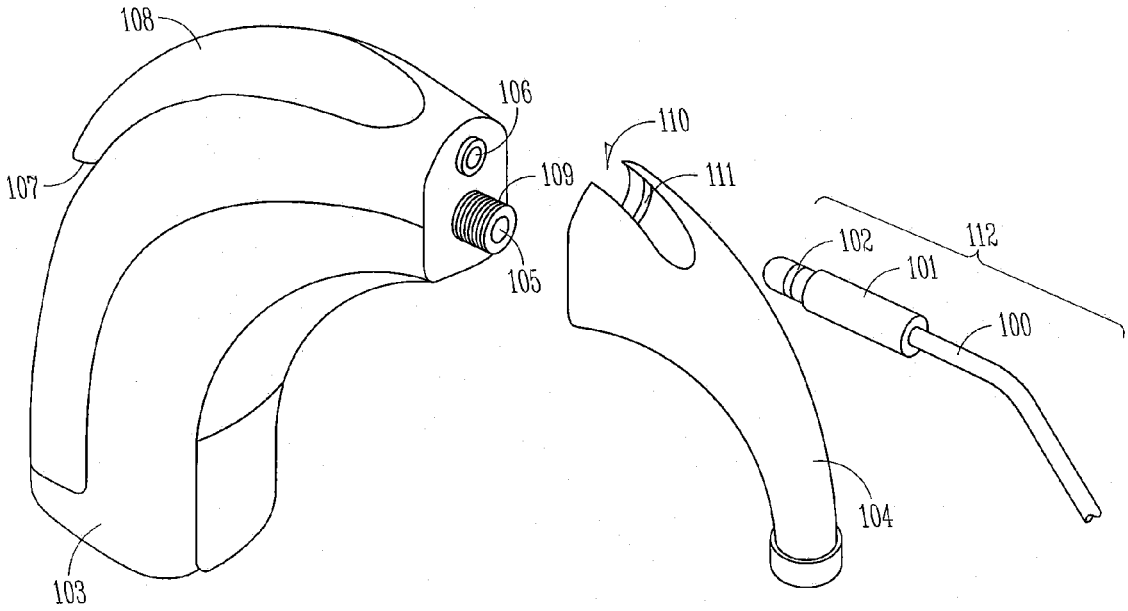
FIG. 1B illustrates an embodiment of a hearing assistance device according to the present subject matter.

FIG. 1B illustrates an embodiment of a hearing assistance device. The illustrated hearing assistance device includes a hearing assistance device housing 103, a flexible sound tube 112 and an earhook 104. In the illustrated example, the hearing assistance device housing 103 includes a port 105 for sound emanating from a receiver enclosed in the housing 103, a first input opening 106 for guiding sound to a microphone, and a second input opening 107 located adjacent a microphone hood 108. In various embodiments, microphones of various types are disposed within the hearing assistance device for receiving sound, such as, omni-directional microphones, directional microphones or combinations thereof. In some examples, a microphone is associated with each input opening. In some examples, a microphone uses multiple openings to receive sound.

In the illustrated example, the earhook 104 accommodates a receiver enclosed in the hearing assistance device housing. In various embodiments, the earhook accommodates wired or wireless receivers located remotely from the hearing assistance device housing. The illustrated earhook of FIG. 1B uses a threaded connector 109 to attach to the hearing assistance device housing 103. In various embodiments, the earhook 104 attaches using a friction fit connector or a twist and lock connector. The illustrated earhook includes a receptacle 110 to accommodate the connection of the flexible sound tube 112. In the illustrated example of FIG. 1B, upon connection of the earhook 104 to the hearing assistance electronics housing 103, the sound tube receptacle 110 of the earhook 104 is aligned with the first microphone port 106 of the housing 103.

The sound tube plug 101 attaches to the earhook 104 using the sound tube receptacle 110. In the illustrated example, the plug 101 is pressed into the receptacle 110 such that the recess 102 of the plug 101 mates with the raised profile 111 of the receptacle 110. As the plug 101 presses into the receptacle 110, the plug material compresses to pass through the restricted opening of the receptacle slot. After the plug 101 fully enters the slot, the plug material relaxes and expands to fill the receptacle 110 thus forming a sound-tight connection. The open portion of the receptacle 110, allows verification of the connection in that the user can verify the end of the plug is flush with the face of the hearing assistance device housing. The open portion of the receptacle 110 also allows the user to observe the mating of the sound tube plug recess 102 with the corresponding raised profile 111 of the sound tube receptacle 110.

Figure 1C:
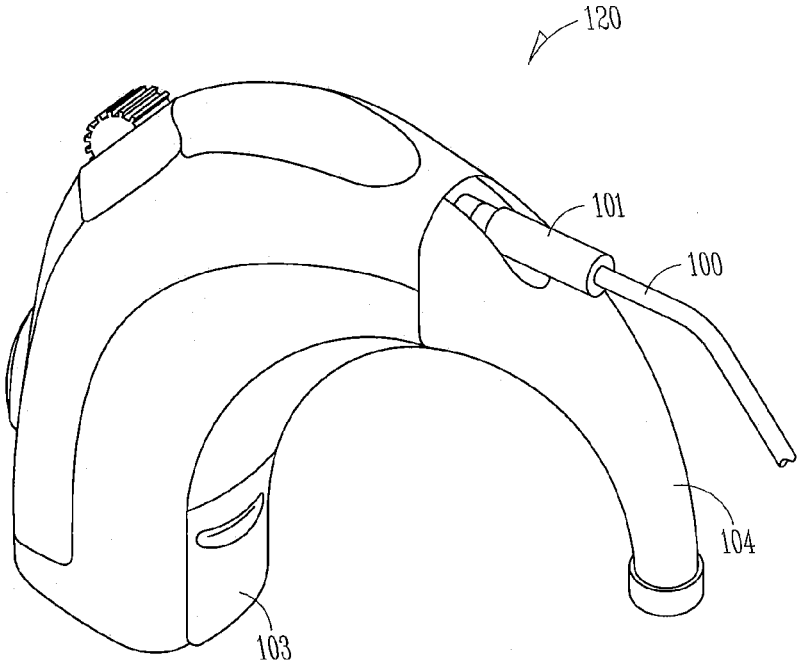
FIG. 1C illustrates an assembled real ear measurement system according to an embodiment of the present subject matter.

FIG. 1C illustrates an assembled real ear measurement system according to one embodiment of the present subject matter. FIG. 1C includes a hearing assistance device housing 103, a flexible sound tube 100 with a plug 101 and an earhook 104 according to the present subject matter. The assembled embodiment shows the plug 101 of the sound tube engaged in the receptacle of the earhook 104 attached to the hearing assistance device housing 103.

Figure 2:
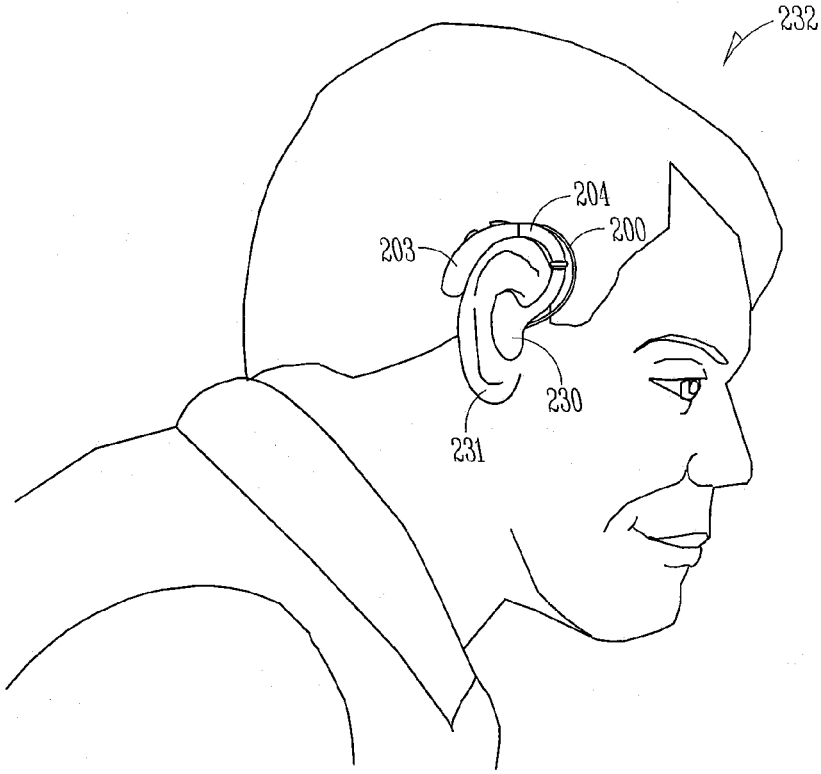
FIG. 2 illustrates an embodiment of a real ear measurement system in place to perform a real ear measurement of an ear of a user.

FIG. 2 illustrates an embodiment of a real ear measurement system in place to perform a real ear measurement of an ear 231 of a user 232. The illustrated example shows a user 232 wearing a hearing assistance device housing 203 with a connected earhook 204 and flexible tube 200. The unconnected end of the flexible tube 100 is inserted into the user's ear canal along side an earmold 230 connected to the earhook 204. The end of the flexible tube extending into the ear canal should be close to the eardrum, for example, approximately 5 mm from the eardrum, to minimize the collection of bad measurements. In various examples, the thin, flexible tube is connected to housing designs other than the illustrated behind-the-ear design, for example, over-the-ear, on-the-ear and custom housings designs may be employed with the thin, flexible sound tube. During an ear measurement, a calibrated sound is emitted from the receiver of the hearing assistance device. The calibrated sound, as detected in the ear canal, is received by a first microphone of the hearing assistance device using the flexible sound tube. Because the transfer function of the flexible sound tube is easily derived and/or obtained, the hearing assistance electronics digitize a signal representing the actual sound pressure level (SPL) in the ear canal over a desired range of frequencies.

Figure 3:
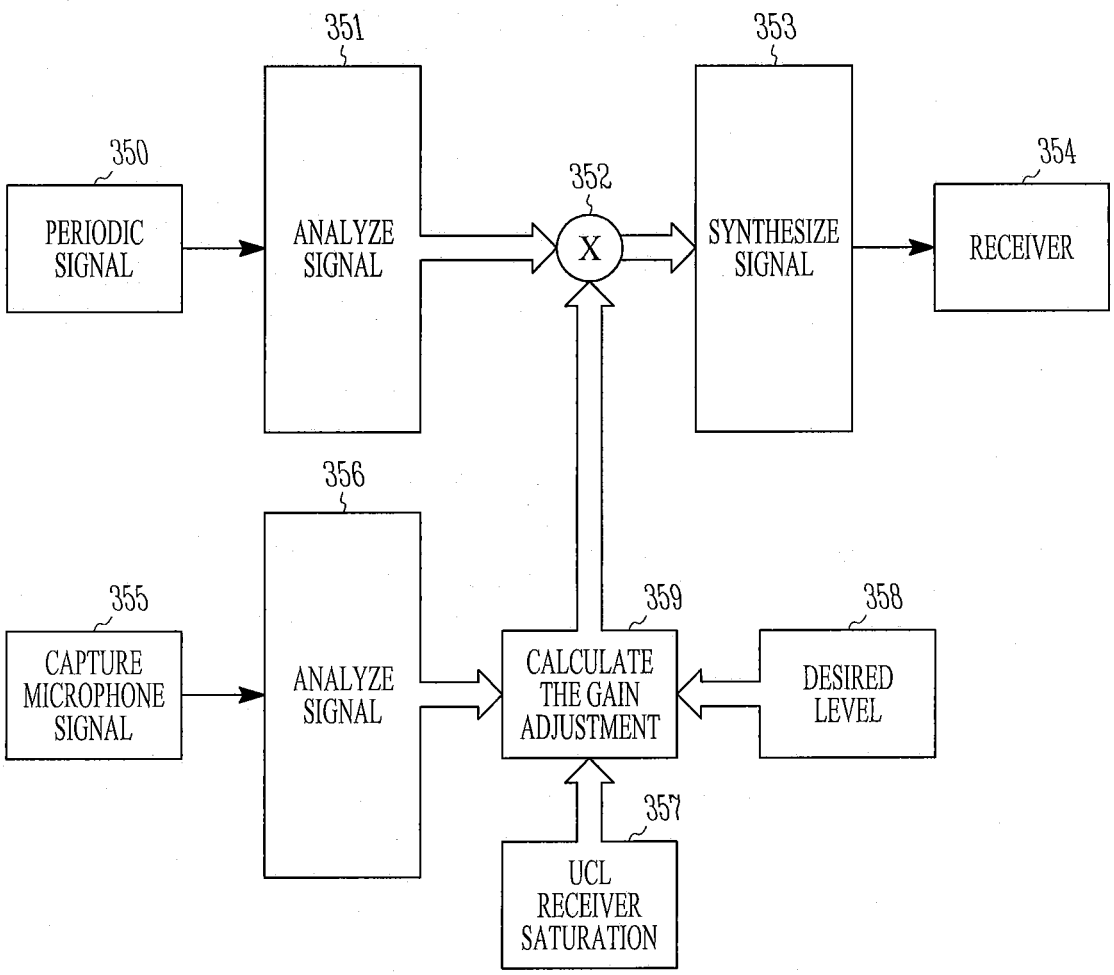
FIG. 3 illustrates a first portion of a method of executing a real ear measurement according to an embodiment of the present subject matter.
Figure 4:
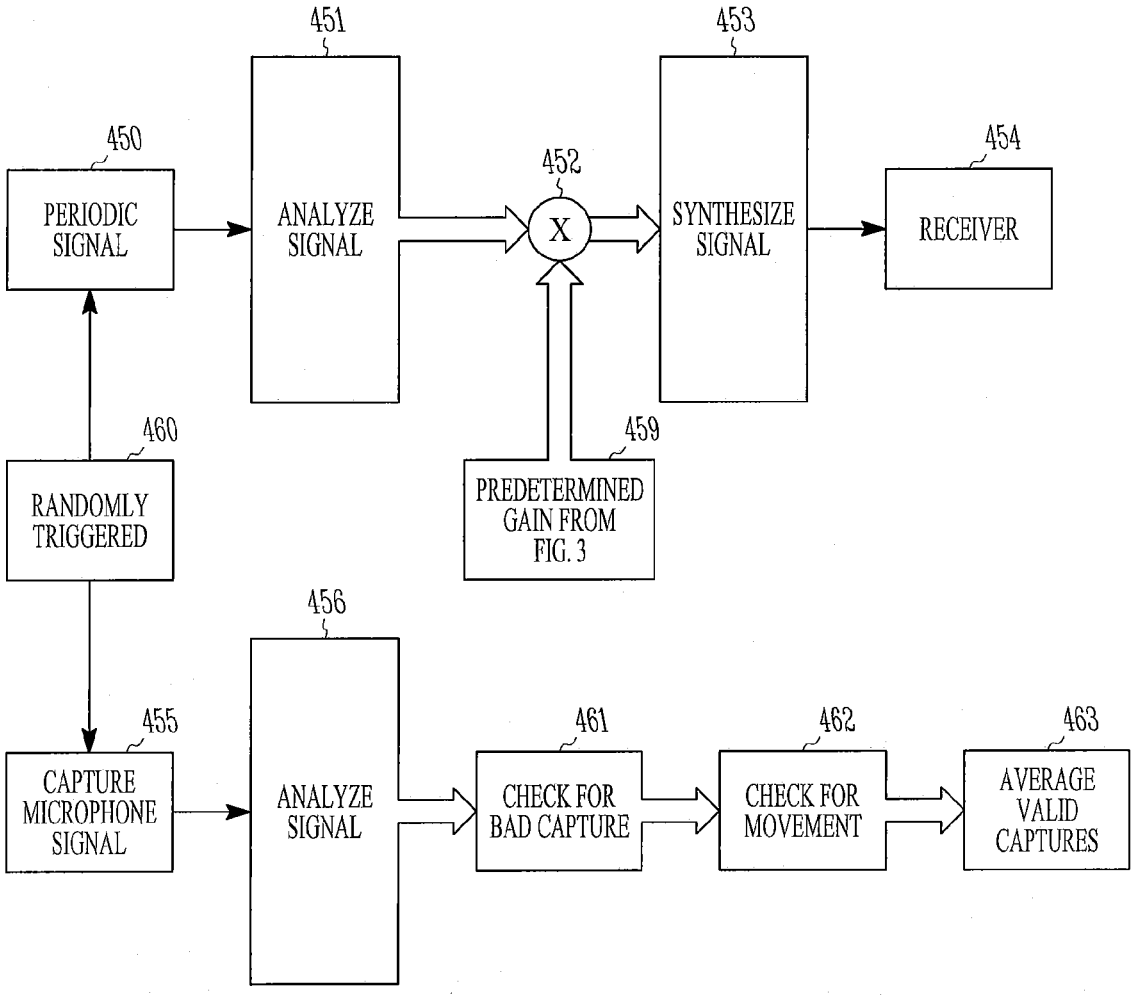
FIG. 4 illustrates a second portion of a method of executing a real ear measurement according to an embodiment of the present subject matter.

FIGS. 3 and 4 demonstrate a first process and a second process useful for ear measurements according to one embodiment of the present subject matter. A patient is given a hearing assistance device fitted with the thin, flexible tube 100 of FIG. 1C, the thin, flexible tube connected to the earhook 104 and proximate the sound tube microphone opening 106. Prior to providing the hearing assistance device, a coupler response of the hearing assistance device conducted at the factory is stored in the memory of the hearing assistance device for use as a reference for subsequent measurements of the user's ear canal. Additionally, data relating to the coupler response of the hearing assistance device over a broad range of parameter settings, or the electro-acoustical behavior of the hearing assistance device, is also stored in the memory of the hearing assistance device.

In some embodiments, the hearing assistance device is in communication with a programmer. The programmer sends a command to initiate a fitting procedure. In other embodiments, a programmer is not connected and the fitting procedure is initiated using the controls of the hearing assistance device. In examples where the hearing assistance device has multiple microphones, only the sound tube microphone is active for the fitting procedure. In examples where the hearing assistance device has multiple input sound openings, some openings are occluded to minimize reception anomalies of the active microphone resulting from multiple sound paths. A microphone opening may be occluded as in FIG. 5 to improve the quality of measurements from the sound tube microphone.

In various examples, a periodic signal 350 is injected into the device during the fitting procedure, converted into the frequency domain by analysis block 351 and amplified 352 by gains 359 calculated to achieve a desired level 358. In other examples, the fitting procedure advances using the hearing assistance device generate the periodic signal. Varying tones of different frequencies are used as the periodic signal 350. These tones are selected to assist in providing a sinusoidal signal of interest to map the transfer function of the listener's actual inner ear canal with the hearing aid in position. In various embodiments, tones are selected at 100 Hertz intervals. The uncomfortable level (UCL) and receiver saturation 357 are monitored to assure the receiver transmits the signal at a level comfortable to the user and within the linear operating of the receiver. In various embodiments, UCL parameters are pre-stored in the hearing assistance electronics and are customized to the user. The resulting amplified tones are converted back into the time domain by synthesis block 353 and played to the receiver 354. The tones played by receiver 354 are picked up by the sound tube in the ear canal and received by the sound tube microphone 355. The gain of the system is thus adjusted to the desired levels for frequency regions of interest.

After the gains are established, the system can perform the process of FIG. 4. In various embodiments, periodic signals of interest 450 are injected into the hearing aid signal channel. In some examples, the hearing assistance device generates and injects the periodic signals of interest 450. The signal is then converted into frequency domain by the analysis block 451 and amplified as a function of frequency 452 with gains as provided by the prior process 459. The conversion of the signal to the frequency domain in blocks 451 and 456 of FIG. 4 and blocks 351 and 356 of FIG. 3 is achieved by transforms well known in the art, for example, a filter bank, FFT or other transformation to convert the signal from the time domain into the frequency domain. The resulting amplified signals are converted into the time domain by synthesis block 453 and played by receiver 454. The sound tube microphone receives the sound 455 near the eardrum and the received sound is converted into a frequency domain signal at analysis block 456. The system then looks at temporal variations in the microphone response while in the frequency domain to determine if momentary interferences (or bad capture) 461 and/or body movements 462 are present. Such samples are rejected and only "clean" samples are used to generate a more accurate running average 463 of the microphone response. To minimize the effects of captured anomalies several samples are collected. In various embodiments, up to 500 samples are collected. Embodiments with more memory collect more than 500 samples. In one embodiment, microphone signal capture is randomly triggered 460 to increase resistance to periodic interference, such as talking or coughing during measurement The process is repeated several times for each desired frequency such that a statistically accurate representation of the user's real ear response is obtained using the stored data. The use of periodic sinusoidal tones allows the processes to provide a shorter analysis and determination of real ear response as compared to analysis of random or white noise stimuli. In various embodiments, the analysis and capture of samples of real ear measurements is completed in 2.5 to 5 seconds depending on the number of rejected samples, the total samples collected and transducer sensitivity. The use of periodic, sinusoidal tones also provides resistance to biases introduced to the saved data by background noise.

After the fitting procedure measures the response of the user's ear, the response is processed with the pre-stored coupler response to produce the real-ear coupler difference (RECD). The RECD is stored in the memory of the hearing assistance device. The thin tube is removed as the RECD and the stored electro acoustical behavior of the hearing assistance device is used to provide accurate data of the actual response of the user's ear. A programmer in communication with the hearing assistance device can display data received from the hearing assistance device. Such data accurately indicates the input to and the output of the actual hearing assistance device while in the ear of the actual user, instead of an approximation based on average RECDs and average coupler responses. Such information can be used to provide additional diagnoses and/or treatment of the user.

Figure 5:
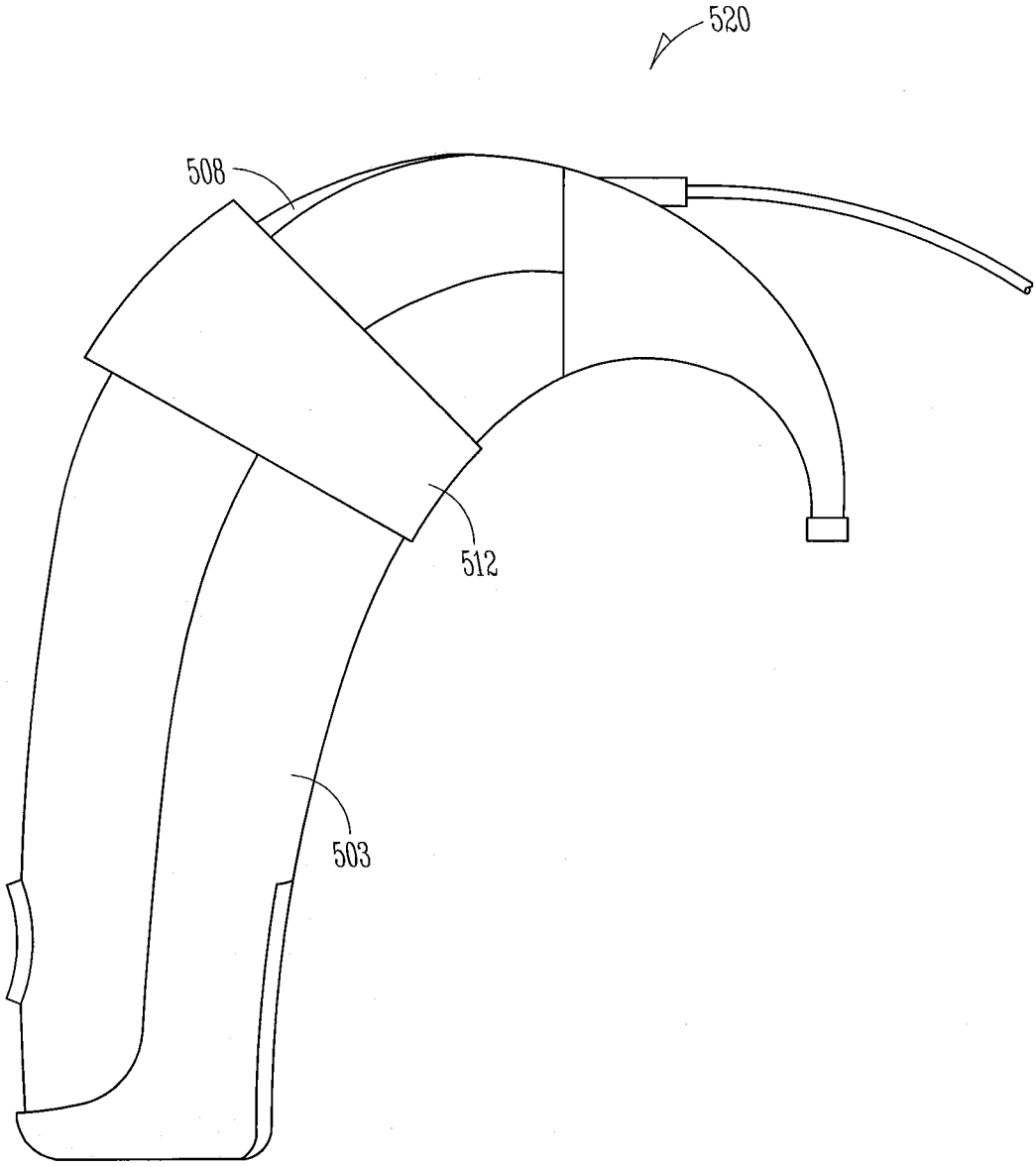
FIG. 5 illustrates an embodiment of a behind-the-ear (BTE) hearing assistance device with a microphone port blocked.

FIG. 5 illustrates an example of a behind-the-ear hearing assistance device 520 with a microphone port blocked to minimize interference with a real-ear measurement. The illustrated hearing assistance device includes a band of stretchable material 512 positioned about the housing 503. The device is shown with the band 512 in a position such that a second microphone port located under the protruding microphone hood 508 is occluded by the placement of the stretchable band of material 512 over the port opening. The band is manually positioned and can be removed or slid to a different location than illustrated to allow sound to access the port. In various embodiments, a port is occluded with a plug inserted in to the port opening.

This application is intended to cover adaptations or variations of the present subject matter. It is to be understood that the above description is intended to be illustrative, and not restrictive. The scope of the present subject matter should be determined with reference to the appended claims, along with the full scope of equivalents to which such claims are entitled.

What is claimed is:

1. A hearing assistance apparatus for performing a real ear measurement, comprising:

a hearing assistance device housing;

a microphone within the housing;

the housing having a first opening for guiding sound into the housing to the microphone;

an earhook connected to the housing, wherein the housing and the connected earhook form an interface, wherein the earhook has a shape to provide a slot near the interface of the housing and the earhook; and a flexible tube for guiding sound, the flexible tube having a first end and a second end, wherein the first end of the flexible tube and the slot of the earhook cooperate to retain the first end of the flexible tube in the slot of the earhook and flush with the housing to provide a sound-tight connection with the first opening.

2. The apparatus of claim 1, wherein the earhook is detachably connected to the housing.

3. The apparatus of claim 2, wherein the earhook is detachably connected to the housing a threaded connector.

4. The apparatus of claim 1, wherein the earhook has a proximate end to connect to the housing and a distal end, the housing includes a receiver, and the earhook accommodates the receiver to deliver sound from the receiver to the distal end of the earhook.

5. The apparatus of claim 1, wherein the earhook accommodates a receiver located remote from the housing.

6. The apparatus of claim 1, wherein the slot has a restricted opening, and the first end of the flexible tube is compressible to pass through the restricted opening of the slot and expand within the slot.

7. The apparatus of claim 1, wherein the first end of the flexible tube and the slot have a matable profile where a recess mates with a raised portion.

8. The apparatus of claim 1, wherein the housing includes a second opening for guiding sound into the housing, the apparatus further including a stretchable band of material to wrap round the housing and adapted to be manually positioned over the second opening.

9. The apparatus of claim 1, wherein the housing includes a second opening for guiding sound into the housing, the apparatus further including a plug adapted to be inserted into the second opening.

10. The apparatus of claim 1, wherein the hearing assistance apparatus is adapted to:

present a periodic signal to the receiver to provide sound in a user's ear canal;

use the microphone and the flexible tube to capture a plurality of samples from the sound provided by the receiver for each desired frequency; and store the plurality of sound samples in the memory.

11. A hearing assistance apparatus for performing a real ear measurement, comprising:

a hearing assistance device housing;

a microphone within the housing;

the housing having a first opening for guiding sound into the housing to the microphone;

an earhook detachably connected to the housing, wherein the housing and the connected earhook form an interface, wherein the earhook has a shape to provide a slot near the interface of the housing and the earhook; and a flexible tube for guiding sound, the flexible tube having a first end and a second end, wherein the first end of the flexible tube and the slot of the earhook cooperate to retain the first end of the flexible tube in the slot of the earhook and flush with the housing to provide a sound-tight connection with the first opening, wherein the hearing assistance apparatus is adapted to:

present a periodic signal to the receiver to provide sound in a user's ear canal;

use the microphone and the flexible tube to capture a plurality of samples from the sound provided by the receiver for each desired frequency; and store the plurality of sound samples in the memory.

12. The apparatus of claim 11, wherein the earhook is detachably connected to the housing a threaded connector.

13. The apparatus of claim 11, wherein the earhook has a proximate end to connect to the housing and a distal end, the housing includes a receiver, and the earhook accommodates the receiver to deliver sound from the receiver to the distal end of the earhook.

14. The apparatus of claim 11, wherein the earhook accommodates a receiver located remote from the housing.

15. The apparatus of claim 11, wherein the slot has a restricted opening, and the first end of the flexible tube is compressible to pass through the restricted opening of the slot and expand within the slot.

16. The apparatus of claim 11, wherein the first end of the flexible tube and the slot have a matable profile where a recess mates with a raised portion.

17. The apparatus of claim 11, wherein the housing includes a second opening for guiding sound into the housing, the apparatus further including a stretchable band of material to wrap round the housing and adapted to be manually positioned over the second opening.

18. The apparatus of claim 11, wherein the housing includes a second opening for guiding sound into the housing, the apparatus further including a plug adapted to be inserted into the second opening.

19. A hearing assistance apparatus for performing a real ear measurement, comprising:

a hearing assistance device housing;

a microphone within the housing;

the housing having a first opening for guiding sound into the housing to the microphone;

an earhook detachably connected to the housing, wherein the housing and the connected earhook form an interface, wherein the earhook has a shape to provide a slot near the interface of the housing and the earhook, wherein the earhook has a proximate end to connect to the housing and a distal end, the housing includes a receiver, and the earhook accommodates the receiver to deliver sound from the receiver to the distal end of the earhook; and a flexible tube for guiding sound, the flexible tube having a first end and a second end, wherein the first end of the flexible tube and the slot of the earhook cooperate to retain the first end of the flexible tube in the slot of the earhook and flush with the housing to provide a sound-tight connection with the first opening.

20. The apparatus of claim 19, wherein the earhook is detachably connected to the housing a threaded connector.

21. The apparatus of claim 19, wherein the slot has a restricted opening, and the first end of the flexible tube is compressible to pass through the restricted opening of the slot and expand within the slot.

22. The apparatus of claim 19, wherein the first end of the flexible tube and the slot have a matable profile where a recess mates with a raised portion.

23. The apparatus of claim 19, wherein the housing includes a second opening for guiding sound into the housing, the apparatus further including a stretchable band of material to wrap round the housing and adapted to be manually positioned over the second opening.

24. The apparatus of claim 19, wherein the housing includes a second opening for guiding sound into the housing, the apparatus further including a plug adapted to be inserted into the second opening.

* * * * *

UNITED STATES PATENT AND TRADEMARK OFFICE

CERTIFICATE OF CORRECTION

PATENT NO. : 8,452,021 B2
APPLICATION NO. : 12/102602
DATED : May 28, 2013
INVENTOR(S) : Yanz et al.

It is certified that error appears in the above-identified patent and that said Letters Patent is hereby corrected as shown below:

In the Claims

In Column 6, line 22, In Claim 3, after "housing", insert --using--, therefor

In Column 7, line 12, In Claim 11, after "receiver", delete "for each desired frequency", therefor In Column 7, line 15, In Claim 12, after "housing", insert --using--, therefor Signed and Sealed this
Second Day of December, 2014

Michelle K. Lee

Michelle K. Lee
*Deputy Director of the United States Patent and Trademark Office*